US006078291A

United States Patent [19]

Paulick et al.

[11] Patent Number: 6,078,291

[45] **Date of Patent: *Jun. 20, 2000**

[54] ANTENNA ASSEMBLY AND METHOD FOR ATTACHING AN ANTENNA

[75] Inventors: Thomas Eugene Paulick, Palatine, Ill.; Thomas John Pack, Boca Raton, Fla.; Richard William Farkas, Pflugerville, Tex.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/719,197

[22] Filed: Sep. 24, 1996

[51] Int. Cl.[7] ..... H01Q 1/24

[52] U.S. Cl. ..... 343/702; 343/906; 343/901

[58] Field of Search ..... 343/702, 900, 343/901, 906, 888; 455/89, 90; H01Q 1/24

[56] References Cited

U.S. PATENT DOCUMENTS 5,469,177 11/1995 Rush ..... 343/702

5,596,334 1/1997 Boyce et al. ..... 343/702

5,606,327 2/1997 Elliott et al. ..... 343/702

OTHER PUBLICATIONS

McMaster–Carr Supply Company, Net Prices, Catalog 88, "Tamperproof Screws," p. 1735.

*Primary Examiner*—Hoanganh Le

*Attorney, Agent, or Firm*—John J. King; Daniel R. Collopy

[57] ABSTRACT

A novel antenna arrangement enables the fully automated insertion of an antenna assembly in a communication device (100), such as a cellular radio telephone. A mounting bracket (112) for the antenna assembly is designed to stand in place to enable reflowing of solder to attach the mounting bracket to the circuit board. According to another aspect of the invention, the sleeve (130) and corresponding head (132) of the antenna assembly operatively couple to enable insertion of the sleeve into the mounting bracket, while preventing removal of the sleeve with the head. Preferably, the lower surface of the head is designed to enable the clockwise rotation of the sleeve, while preventing the counterclockwise rotation of the sleeve. Also, the sleeve is designed to receive a removal device to rotate the sleeve in the counterclockwise direction for removal.

24 Claims, 3 Drawing Sheets

ANTENNA ASSEMBLY AND METHOD FOR ATTACHING AN ANTENNA

FIELD OF THE INVENTION

This present invention is generally related to electronic devices, and more particularly to a method for attaching a component to an electronic device.

BACKGROUND OF THE INVENTION

With continued advances in technology and manufacturing techniques, many processes which would normally be done manually have been automated. However, certain tasks or processes remain difficult to automate. For example, attaching certain brackets, such as an antenna bracket, has been done manually. Similarly, attaching an antenna to the antenna bracket would also have done manually. Such manual labor not only increases the risk of a defect in the product, but also substantially increases the cost of manufacturing the product. Accordingly, there is a need for an antenna assembly and a method for attaching an antenna which enables the automatic insertion of the antenna bracket and antenna.

DETAILED DESCRIPTION OF THE INVENTION

The present invention enables the fully automated insertion of an antenna assembly in a communication device, such as a cellular radio telephone. A mounting bracket for the antenna assembly is designed to stand in place to enable reflowing of solder to attach the mounting bracket to the circuit board. Preferably, the mounting bracket has two orthogonal legs to form a "corner" and various standoffs to enable the mounting bracket to stand on its own. According to another aspect of the invention, the sleeve and corresponding head of the antenna assembly operatively couple to enable insertion of the sleeve into the mounting bracket, while preventing removal of the sleeve with the head. Preferably, the lower surface of the head is designed to enable the clockwise rotation of the sleeve, while preventing the counterclockwise rotation of the sleeve. Also, the sleeve is designed to receive a removal device to rotate the sleeve in the counterclockwise direction for removal.

According to an alternate embodiment of the invention, shear heads are positioned on the lower surface of the head. When the head is rotated at a certain torque, the shear heads are designed to break off after the sleeve has been attached to the mounting bracket. Accordingly, the antenna assembly can be attached to the mounting bracket but cannot be removed by the head after the blades have broken off.

Figure 1:
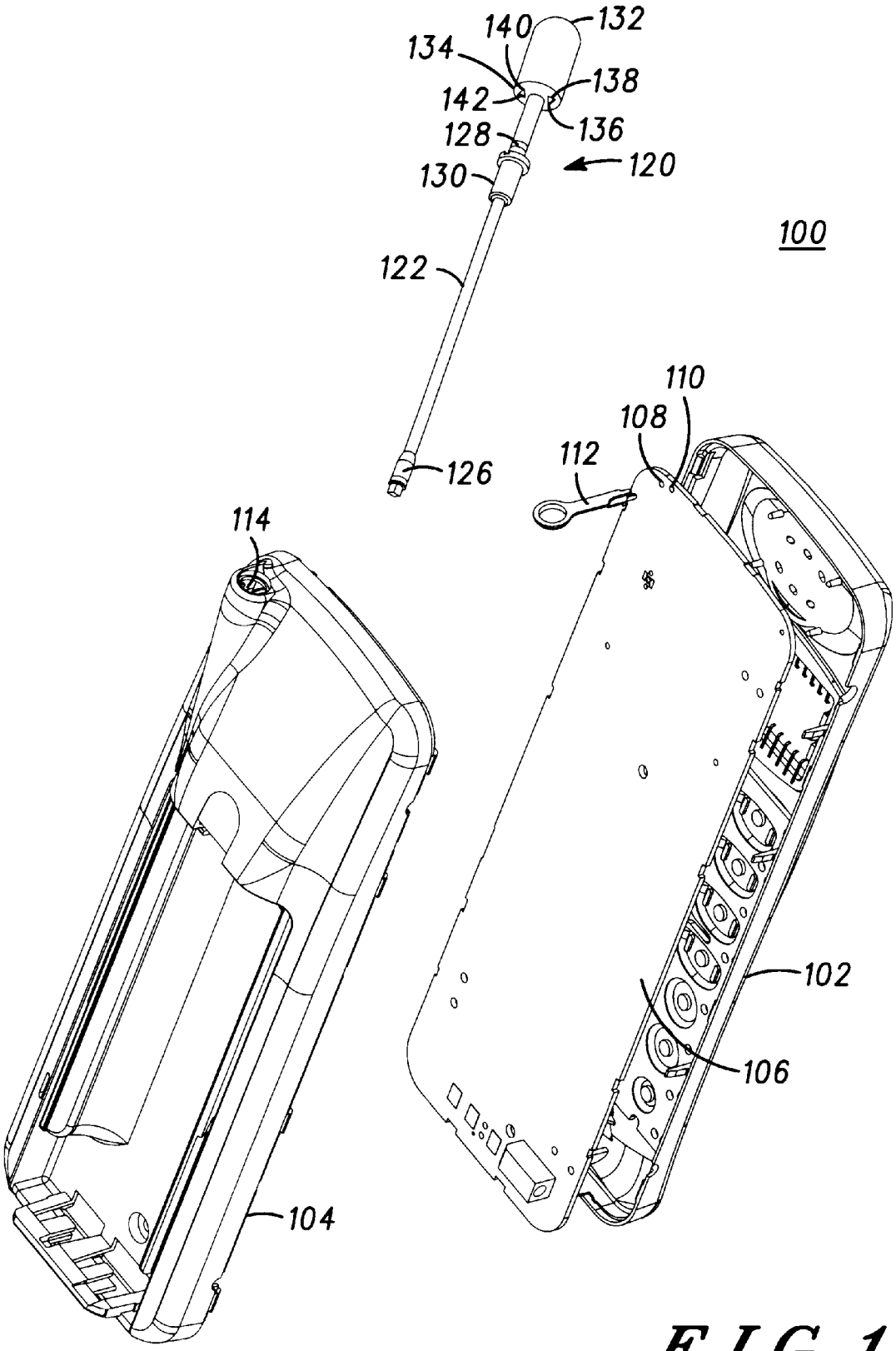
FIG. 1 is an exploded view of a wireless communication device according to the present invention.

Turning now to FIG. 1, a wireless communication device 100 having a front housing 102 and a rear housing 104 are adapted to enclose a printed circuit board 106 having components to enable communication in a wireless communication network, such as a cellular radio telephone network. Printed circuit board 106 preferably includes conventional through-holes 108 and 110 to receive a mounting bracket 112. Mounting bracket 112 will be described in more detail in reference to FIG. 2.

Rear housing 104 also includes an antenna aperture 114 for receiving an antenna 120. Antenna 120 includes a mast 122 having a lower contact 126 and an upper contact 128. The antenna further includes a sleeve 130 which is adapted to be coupled to mounting bracket 112. As will be shown in more detail in reference to FIG. 3, a lower portion of sleeve 130 is threaded to couple to mounting bracket 112. Antenna 120 can move within sleeve 130 between a raised and lowered position. In the raised position, contact 126 is coupled to sleeve 130. In the lowered position, contact 128 is coupled to sleeve 130. A head 132 has a lower surface 134 adapted to interface with sleeve 130. As can be seen, two protrusions generally forming "ramps" which extend to a ledge are shown. Such protrusions can easily be formed in the lower surface by drawing the metal down. Alternate embodiments shown in FIGS. 4 and 5 generally show larger protrusions which extend from the mast to the edge of the head. However, the interaction of the head with sleeve 130 remains the same and will be described in detail in reference to FIGS. 3–5. The operation of head 132 and sleeve 130 will be described in more detail in reference to FIGS. 3 and 4.

Figure 2:
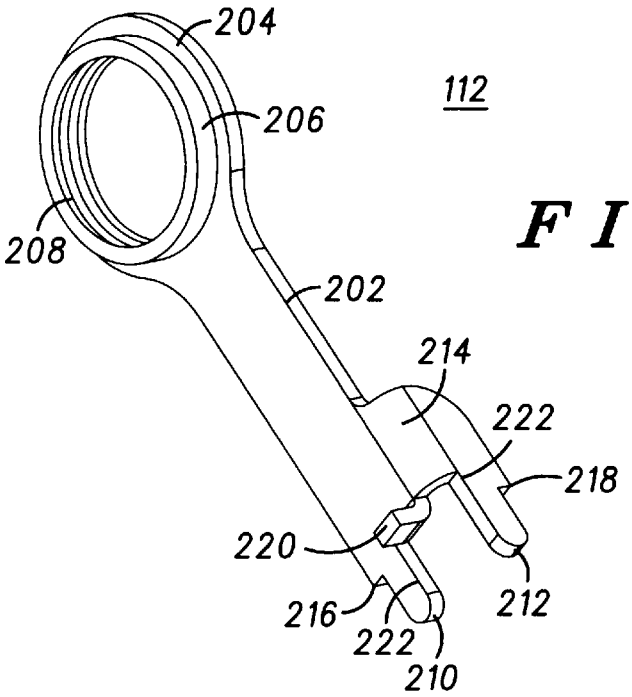
FIG. 2 is a perspective view of mounting bracket 112 shown in FIG. 1 according to the present invention.

Turning now to FIG. 2, an enlarged view of mounting bracket 112 is shown. Preferably, mounting bracket 112 includes a shaft 202 coupled to a receiving ring 204 having a cylinder 206 with threads 208. Threads 208 of cylinder 206 are adapted to engage corresponding threads of sleeve 130. Mounting bracket 112 also includes a plurality of leads, such as leads 210 and 212. Leads 210 and 212, in addition to enabling the automated mounting of the antenna assembly, also provide an electrical connection to printed circuit board 106 for coupling RF signals between antenna and the printed circuit board of the communication device.

Preferably, a comer member 214 is designed such that lead 212 is positioned orthogonal to lead 210. Also, leads 210 and 212 have feet or standoffs 216 and 218, respectively, which control the depth of the mounting bracket and enables the mounting bracket to stand when placed in through-holes 108 and 110 of the printed circuit board. Accordingly, the mounting bracket can be automatically reflow soldered, eliminating the need for hand soldering. Optionally, mounting bracket 112 could include a flange 220 to provide further support, both before and after soldering. Finally, the leads are preferably rectangular in shape to enable a press fit in the conventional circular through-holes. In particular, each lead preferably includes edges 222 adapted for skiving the board to further maintain the bracket in place during the reflow soldering process. Although the specific shape of the bracket is shown in FIG. 2, any other shape which would enable the mounting bracket to stand when placed in through-holes could be employed according the spirit and scope of the present invention.

Figure 3:
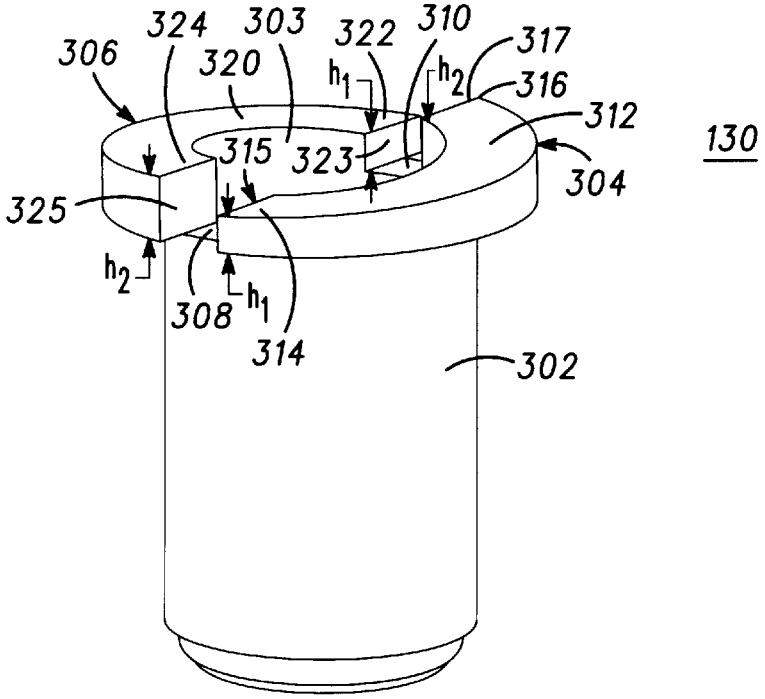
FIG. 3 is a perspective view of sleeve 130 of FIG. 1 according to the present invention.

Turning now to FIG. 3, a perspective view of sleeve 130 is shown. Preferably, the sleeve includes a cylinder 302 having a hollow portion 303 to receive mast 122 of the antenna, and a threaded lower portion 303. The upper surface of the cylinder 302 includes ramp portions 304 and 306, which are separated by gaps 308 and 310. Ramp portion 304 includes an inclined surface 312 extending from a first ledge or elevated end portion 314 to a second ledge or elevated end portion 316. Preferably, elevated end portion 314 extends to a first height hi, while the second elevated end portion 316 extends to a second height h2, which is generally greater than first height h1. Similarly, ramp portion 306 includes an inclined surface 320 extending from a third ledge or elevated end portion 322 to a fourth ledge or elevated end portion 324. Third elevated end 322 extends to a first height h1, while the fourth elevated end 324 extends to a second height h2. The functionality of sleeve 130 will be described in reference to FIG. 4. Preferably, the lower end portions 314 and 322 of the ramp portions 304 and 306 respectively are at a height h1 to enable a removing tool to be inserted to remove sleeve 130. However, sleeve 130 could be designed where gaps 308 and 310 do not exist, eliminating the ability to remove the sleeve if desired.

Figure 4:
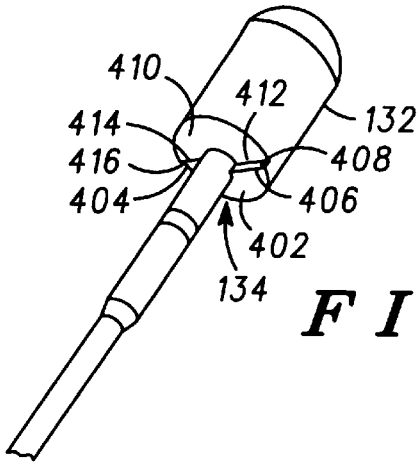
FIG. 4 is an enlarged view of an alternate embodiment of head portion 132 of FIG. 1 according to the present invention.

Turning now to FIG. 4, lower surface 134 of head 132, corresponding to ramp portions of sleeve 130, is shown in more detail. In particular, the lower surface includes a first ramp section 402 extending from a lower end portion 404 to a raised end portion 406. The raised end portion 406 terminates at a ledge 408. The corresponding ramp section 410 extends from a lower end 412 at ledge 408 to a raised end 414. Raised end 414 terminates at a second ledge 416 which extends from the raised end of ramp section 410 to the lower end of ramp section 402.

In operation, ledges 408 and 416 of head 132 abut elevated end portions 316 and 325 of sleeve 130 respectively. When rotated in the clockwise direction, the head 132 of the antenna causes sleeve 130 to rotate as the ledges of the head abut the ledges of the sleeve. However, when rotated in the counterclockwise direction, ramp sections 402 and 410 of the head continuously slip against inclined surfaces 312 and 320 of sleeve 130.

Figure 5:
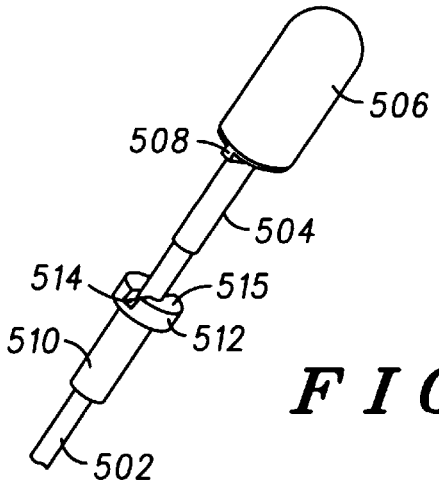
FIG. 5 is an alternate embodiment an antenna head and sleeve arrangement according to the present invention.
Figure 6:
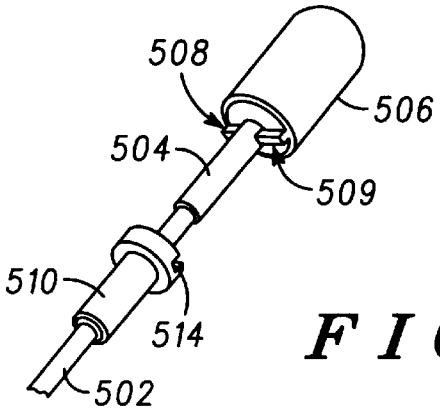
FIG. 6 is a perspective of the alternate embodiment of FIG. 5 more clearly showing the lower surface of the head according to the present invention.

Turning now to FIG. 5, an alternate embodiment of the sleeve and head arrangement is shown. In particular, a mast 502 extends to a contact 504 at the head 506. The lower portion of the head includes blades 508, shown in more detail in FIG. 6. The upper portion 512 of sleeve 510 includes a slot 514 extending laterally through the upper portion. Preferably, the top surface 515 of the upper portion is flat. Blades 508 and 509 are designed to shear at a certain torque. Accordingly, the head 506 is rotated to automatically insert sleeve 510 into the mounting bracket. After the sleeve is tightened to a certain torque, the blades will be severed, allowing the antenna to twist freely within the sleeve. Accordingly, the antenna cannot then be used to remove the sleeve. The blades could be designed to fit securely within recess 514.

Although the invention has been described and illustrated in the above description and drawings, it is understood that this description is given by way of example only and that numerous changes and modifications can be made by those skilled in the art without departing from the true spirit and scope of the invention. Although the present invention finds particular application in portable cellular radiotelephones, the invention could be applied to any portable device, including pagers, electronic organizers, or computers. Our invention should be limited only by the following claims.

We claim:

1. An antenna assembly comprising:

a mast;

a head coupled to a first end of said mast, said head having a lower surface having a first ramp terminating in a first ledge and a second ramp terminating in a second ledge; and a sleeve rotatably mounted on said mast, said sleeve having an upper surface having a third ramp terminating in a third ledge and a fourth ramp terminating in a fourth ledge which is adapted to mate with said lower surface of said head.

2. The antenna assembly of claim 1 wherein said mast further includes a first contact at said first end for maintaining said sleeve adjacent to said head and a second contact at a second end of said mast for maintaining said sleeve at said second end of said mast.

3. The antenna assembly of claim 1 wherein said third ramp and said fourth ramp are separated by a gap.

4. The antenna assembly of claim 3 wherein said third ramp extends from a fifth ledge to said third ledge.

5. The antenna assembly of claim 3 wherein said fourth ramp extends a sixth ledge to said fourth ledge.

6. The antenna assembly of claim 1 wherein said sleeve comprises a threaded lower portion.

7. The antenna assembly of claim 6 further comprising a mounting bracket, said mounting bracket having a threaded portion for receiving said threaded portion of said sleeve.

8. The antenna assembly of claim 7 said mounting bracket including a first lead and a second lead, said first lead and said second lead being positioned orthogonally.

9. An antenna assembly comprising:

a mast having a first contact at said first end of said mast and a second contact at a second end of said mast;

a head having a lower surface coupled to said first end of said mast, said lower surface having a first ramp terminating in a first ledge and a second ramp terminating in a second ledge; and a sleeve rotatably mounted on said mast, said sleeve having an upper surface which is adapted to mate with said lower surface of said head wherein said upper surface of said sleeve comprises a third ramp terminating in a third ledge and a fourth ramp terminating in a fourth ledge.

10. The antenna assembly of claim 9 wherein said third ramp and said fourth ramp are separated by a gap.

11. The antenna assembly of claim 9 wherein said third ramp extends from a fifth ledge to said third ledge.

12. The antenna assembly of claim 9 wherein said fourth ramp extends a sixth ledge to said fourth ledge.

13. The antenna assembly of claim 9 wherein said sleeve comprises a threaded lower portion.

14. The antenna assembly of claim 13 further comprising a mounting bracket, said mounting bracket having a threaded portion for receiving said threaded portion of said sleeve.

15. An antenna assembly comprising:

a mast having a first contact at said first end and a second contact at a second end;

a head having a lower surface coupled to said first end of said mast, said lower surface having a first ramp terminating in a first ledge and a second ramp terminating in a second ledge;

a sleeve rotatably mounted on said mast and having an upper surface which is adapted to mate with said lower surface of said head, wherein said upper surface of said sleeve comprises a third ramp and a fourth ramp which are separated by a gap, a third ramp extending from a third ledge to a fourth ledge and a fourth ramp extending from a fifth ledge to a sixth; and a mounting bracket, said mounting bracket having a threaded portion for receiving a threaded portion of said sleeve.

16. A method for attaching an antenna assembly to a wireless communication device, said method comprising the steps of:

providing a head having a lower surface coupled to a first end of a mast, said lower surface having a first ramp terminating in a first ledge and a second ramp terminating in a second ledge;

rotatably mounting a sleeve on said mast, said sleeve having an upper surface having a third ramp and a fourth ramp which is adapted to mate with said lower surface of said head; and rotating said head of said antenna to attach said sleeve to said mounting bracket.

17. The method for attaching an antenna of claim 16 further including a step of inserting a mounting bracket into a printed circuit board.

18. The method for attaching an antenna of claim 17 further including a step of reflow soldering the printed circuit board to solder the mounting bracket to the printed circuit board.

19. The method for attaching an antenna of claim 16 further including a step of separating said third ramp and said fourth ramp by a gap.

20. The method for attaching an antenna of claim 19 further including extending said third ramp from a third ledge to a fourth ledge and extending said fourth ramp from a fifth ledge to a sixth.

21. A method for attaching an antenna assembly to a wireless communication device, said method comprising the steps of:

attaching a mounting bracket having a threaded portion to a circuit board; and coupling a head having a lower surface having a first ramp terminating in a first ledge and a second ramp terminating in a second ledge to a first end of a mast;

rotatably mounting a sleeve having a third ramp terminating in a third ledge and a fourth ramp terminating in a fourth ledge on said mast;

mating an upper surface of said sleeve with a lower surface of said head; and rotating said head of said antenna to insert said sleeve into said mounting bracket.

22. A method for attaching an antenna assembly to a wireless communication device, said method comprising the steps of:

coupling a head to a first end of a mast, said head having a first ramp terminating in a first ledge and a second ramp terminating in a second ledge on a lower surface;

rotatably mounting a sleeve on said mast;

mating an upper surface of said sleeve with a lower surface of said head, said upper surface of said sleeve having a third ramp and a fourth ramp; and rotating said head of said antenna to insert said sleeve into a mounting bracket.

23. The method for attaching an antenna assembly of claim 22 further including a step of separating said third ramp and said fourth ramp by a gap.

24. The method for attaching an antenna assembly of claim 23 further including a step of extending a third ramp from a third ledge to a fourth ledge and extending a fourth ramp from a fifth ledge to a sixth ledge.

* * * * *